US006435500B2

(12) United States Patent
Gumina

(10) Patent No.: US 6,435,500 B2
(45) Date of Patent: Aug. 20, 2002

(54) INTERACTIVE GAMES AND METHOD OF PLAYING

(75) Inventor: Anthony Gumina, Henderson, NV (US)

(73) Assignee: Media Drop-In Productions, Inc., Hartford, CT (US)

( * ) Notice: Subject to any disclaimer, the term of this patent is extended or adjusted under 35 U.S.C. 154(b) by 0 days.

(21) Appl. No.: 09/847,336

(22) Filed: May 3, 2001

Related U.S. Application Data

(63) Continuation of application No. 09/593,764, filed on Jun. 14, 2000, now abandoned, which is a continuation of application No. 09/094,677, filed on Jun. 15, 1998, now abandoned, which is a continuation of application No. 08/686,053, filed on Jul. 24, 1996, now abandoned, which is a continuation of application No. 08/423,692, filed on Apr. 18, 1995, now abandoned, which is a continuation-in-part of application No. 08/068,343, filed on May 28, 1993, now Pat. No. 5,407,199.

(51) Int. Cl.[7] ..... A63F 3/06

(52) U.S. Cl. ..... 273/139; 273/138.1; 273/138.2; 283/901; 283/903

(58) Field of Search ..... 273/139, 138.1, 273/138.2, 269, 292; 463/12, 13; 283/901, 903

(56) References Cited

U.S. PATENT DOCUMENTS

| | | | |
|---|---|---|---|
| 1,527,929 | A | 2/1925 | Simons |
| 3,826,499 | A | 7/1974 | Lenkoff |
| 4,491,319 | A | 1/1985 | Nelson |
| 4,634,149 | A | 1/1987 | Donovan |
| 4,740,016 | A | 4/1988 | Konecny et al. |
| 4,856,787 | A | 8/1989 | Itkis |
| 4,943,090 | A | 7/1990 | Fienberg |
| 5,037,099 | A | 8/1991 | Burtch |
| 5,046,737 | A | 9/1991 | Fienberg |
| 5,092,598 | A | 3/1992 | Kamille |
| 5,118,109 | A | 6/1992 | Gumina |
| 5,407,199 | A | 4/1995 | Gumina |
| 5,630,753 | A | 5/1997 | Fuchs |

FOREIGN PATENT DOCUMENTS

| | | |
|---|---|---|
| GB | 2 075 918 | 11/1981 |

*Primary Examiner*—Benjamin H. Layno
(74) *Attorney, Agent, or Firm*—Shlesinger, Arkwright & Garvey LLP

(57) ABSTRACT

Interactive games provide a player with an opportunity to use skill and knowledge of conventional game strategy to facilitate greater player interest. The games described herein include simulated versions of blackjack, draw poker, hold'em, pick seven and roulette which are playable on video display terminals, scratch-off cards or pull tab cards interchangeably. Each casino game described herein has been modified for use with the card and video format to provide a simulated game which incorporates the strategy of the related casino game.

22 Claims, 7 Drawing Sheets

| FINAL HAND | PRIZE-5 CARDS | PRIZE-6 CARDS | PRIZE-7 CARDS |
|---|---|---|---|
| TWO PAIR | $5 | $2 | NO PRIZE |
| THREE OF A KIND | $10 | $5 | TICKET |
| STRAIGHT | $25 | $10 | $2 |
| FLUSH | $50 | $25 | $5 |
| FULL HOUSE | $100 | $50 | $10 |
| FOUR OF A KIND | $500 | $250 | $100 |
| STRAIGHT FLUSH | $1,000 | $500 | $250 |
| ROYAL FLUSH | $10,000 | $5,000 | $1,000 |

| FINAL HAND | PRIZE-5 CARDS | PRIZE-6 CARDS | PRIZE-7 CARDS |
|---|---|---|---|
| TWO PAIR | $5 | $2 | NO PRIZE |
| THREE OF A KIND | $10 | $5 | TICKET |
| STRAIGHT | $25 | $10 | $2 |
| FLUSH | $50 | $25 | $5 |
| FULL HOUSE | $100 | $50 | $10 |
| FOUR OF A KIND | $500 | $250 | $100 |
| STRAIGHT FLUSH | $1,000 | $500 | $250 |
| ROYAL FLUSH | $10,000 | $5,000 | $1,000 |

INTERACTIVE GAMES AND METHOD OF PLAYING

CROSS REFERENCE TO RELATED APPLICATIONS

THIS APPLICATION IS A CONTINUATION OF application Ser. No. 09/593,764, FILED Jun. 14, 2000 NOW ABANDONED, WHICH IS A CONTINUATION OF application Ser. No. 09/094,677, FILED Jun. 15, 1998 NOW ABANDONED, WHICH IS A CONTINUATION OF application Ser. No. 08/686,053, FILED Jul. 24, 1996 NOW ABANDONED, WHICH IS A CONTINUATION OF application Ser. No. 08/423,692, FILED Apr. 18, 1995 NOW ABANDONED, WHICH IS A CONTINUATION-IN-PART OF application Ser. No. 08/068,343, FILED May 28, 1993, WHICH IS NOW U.S. Pat. No. 5,407,199, ISSUED Apr. 18, 1995, AND EACH OF WHICH IS INCORPORATED HEREIN BY REFERENCE.

FIELD OF THE INVENTION

This invention relates to games involving player selection based upon known games rules and simulates luck of the draw found in common card games and roulette.

BACKGROUND OF THE INVENTION

Previously known card games using a standard 52 card deck as well as common casino gambling games such as roulette, craps and even slot machines have been simulated through the use of ticket games. The patent of Kamille U.S. Pat. No. 5,092,598 shows several typical examples. However, until my U.S. Pat. No. 5,118,109, no prior games involved the use of traditional game rules in the selection process. In my prior instant poker game card, U.S. Pat. No. 5,118,109, incorporated herein by reference the player had the opportunity to exchange each one of the original cards dealt with one other card. However, any skill requirement was reduced since the alternative values for each card were predetermined. For example, when one card of the hand was replaced with another card, the new value received was not similar to a card being drawn from a deck, but each card value had a corresponding replacement card value.

Simulation of being dealt a replacement card from a deck add more realism to the game and heightens player interest. Furthermore, nearly always having a chance to have a winning ticket gives the player the feeling that they can control winning and losing to some extent.

In view of the foregoing, it can be seen that there is a need for a new interactive game and method through the use of opaque coatings on paper substrates, pull tab cards and video display terminals which can more closely imitate the intricacies of known casino gambling games.

OBJECTS AND SUMMARY OF THE INVENTION

An important object of the invention is to provide a new game format which involves strategy and simulates traditional game format conditions.

Another object of the invention is to provide a new game format for playing traditional games of twenty-one, Hold'Em, seven card stud, draw poker and roulette.

Another object of the invention is to provide a game format which can be used in video display terminals, pull tab games, and in scratch-off tickets.

The foregoing drawings will be described in greater detail with respect to the detailed description of the preferred embodiments discussed below.

DETAILED DESCRIPTION OF THE INVENTION

Simulated Blackjack Game

Figure 1:
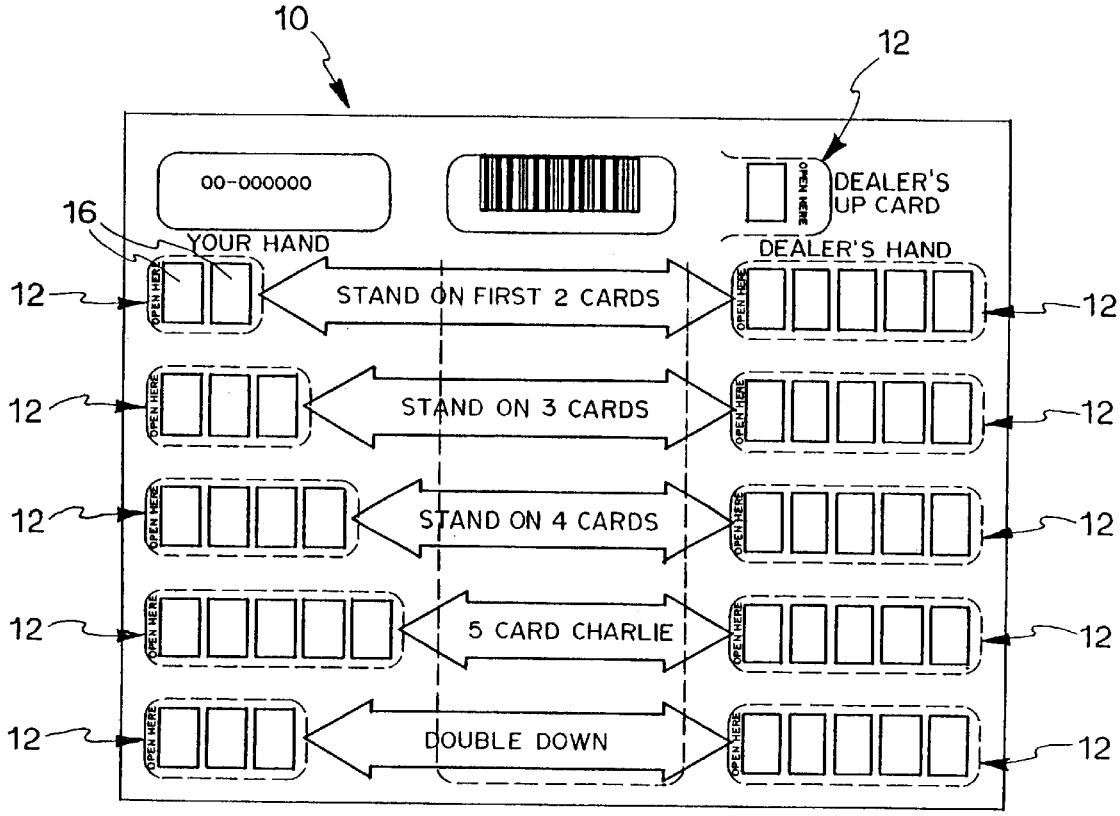
FIG. 1 is a game simulating apparatus simulating the game of twenty-one.
Figure 2:
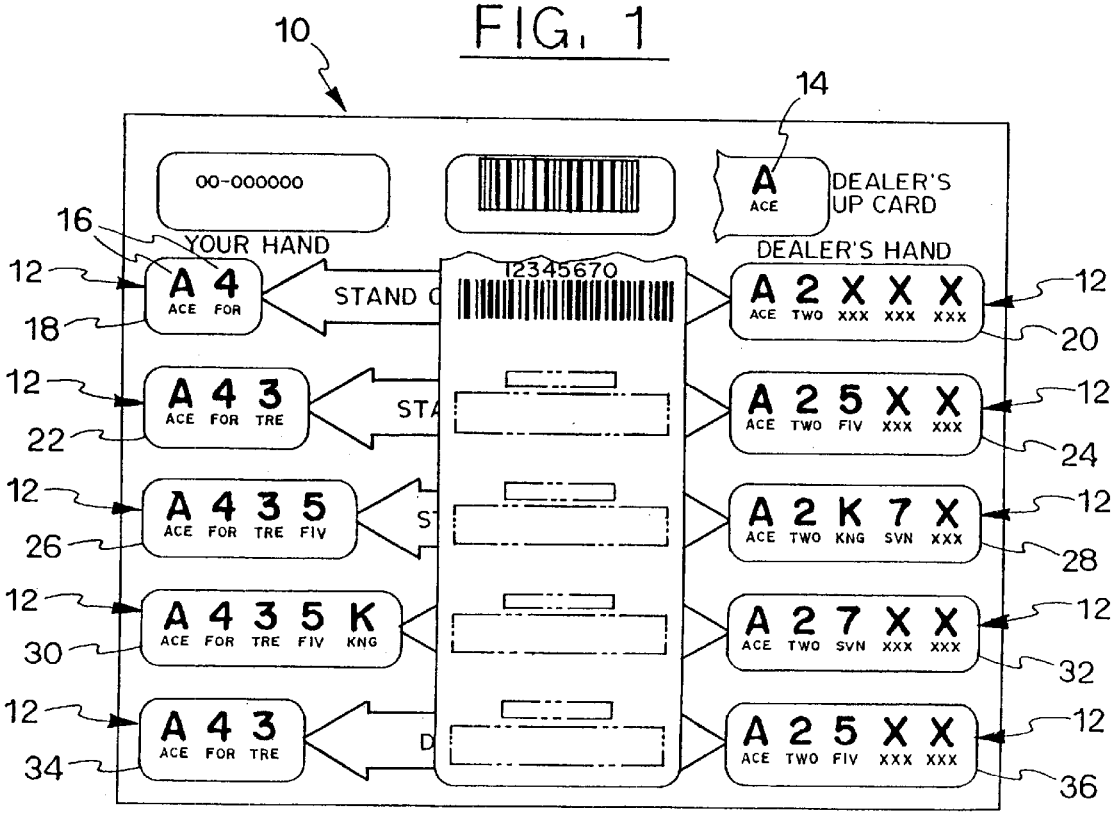
FIG. 2 shows the game simulating apparatus of FIG. 1 with hand values revealed.

FIG. 1 shows a game simulating apparatus 10 for playing the game blackjack or twenty-one. The game simulating apparatus 10 includes preferably a plurality of areas 12 for displaying representative card hand values or the like. The game simulating apparatus 10 could either be a card having pull tabs initially covering the areas 12 could have opaque scratch off material covering the areas 12, or the game simulating apparatus 10 could be a video display terminal having a view screen and areas 12 located on the screen. In case of a video display terminal, the areas 12 may be indicated at the outset or the screen could remain blank or monochromatic until a proper button is pushed. Preferably, the screen would have touch sensors so that selections could be made by actual touching of the screen using known technologies or by pressing buttons on a control panel.

The simulated blackjack game is initiated by revealing the dealer's up card at area 14 and the player's hand at area 16. The area 16 designated as player's hand or "your hand" would include two card values which are shown by way of example as an ace-four combination 18 while the dealer's up card is shown as an ace. At this point the player has the option of standing on the ace-four combination 18 or selecting another card. If the player elects to stand, then the dealer's hand displayed at area 20 showing the dealer's down card displayed having a value of two. Since the dealer would lose if the player stood on the ace four, the dealer would draw another card which is indicated at area 26 as a three thus giving the dealer sixteen and a winning hand over the fifteen showing in the player's hand.

However, if the player elects to draw an additional card identified in area 16, the player would have card values of ace, four and three for a total of eight or eighteen, depending on whether the ace was valued at one or eleven. Going over to the dealer's hand designated at area 24, the dealer would no longer receive the ace, two, three combination since the player was dealt a three the dealer would then receive a new card when he dealt his hand to himself and would receive, for example, ace, two, five, giving the dealer eighteen and thus tying with the player's hand shown in area 22.

However, should the player not elect to stand on eighteen, the player may also select an additional card as shown in area 26. The additional card would be a five so that the player would have an ace, four, three and five combination adding up to thirteen. Since the dealer would no longer receive the five card as noted in area 24, the dealer would now receive a different card, in this case a king giving the dealer thirteen and since the dealer cannot stand below sixteen the dealer would have to take another card which in this case would be a seven and would then have twenty and have a winning hand.

Should the player have not elected to stand on thirteen, the player could elect to draw an additional card which in this case would be the king and the player would bust. Now referring to area 32, the dealer's hand would now not receive the king and the dealer would only receive the seven for a hand of twenty.

The game simulating apparatus 10 may also include the option to double down in a game of twenty-one which is an opportunity to double your bet and receive one additional card as shown at area 34. In this instance the dealer's card hand would be the same as the situation where the player stood on three cards. In practice the double bet would be paid to the game sponsor prior to revealing of the player's double down combination 34. When a video display terminal is used the machine would require a double bet in order to select the double down option.

As can be seen, a basic feature of the game is that the player's choice of how many cards to receive affects the choice of cards the dealer will receive. In practice, this means that the player will select his hand, decide when to stand and then by scratching off an area 12 or removing a pull tab or revealing an area on the video display screen as the case may be, the dealer's hand opposite the player's stand will be revealed. As soon as the dealer's hand is played, the game is over. If the player reveals more than one of the dealer's hands, the card is void. However, this occurrence could be electronically prevented in a video version of the game.

In the pull tab or scratch off versions of the game, control indicia are preferably used on the cards in order to provide security for the game. Control indicia may either be numbers, letters, bar codes and the like.

Hold'EM

Figure 3:
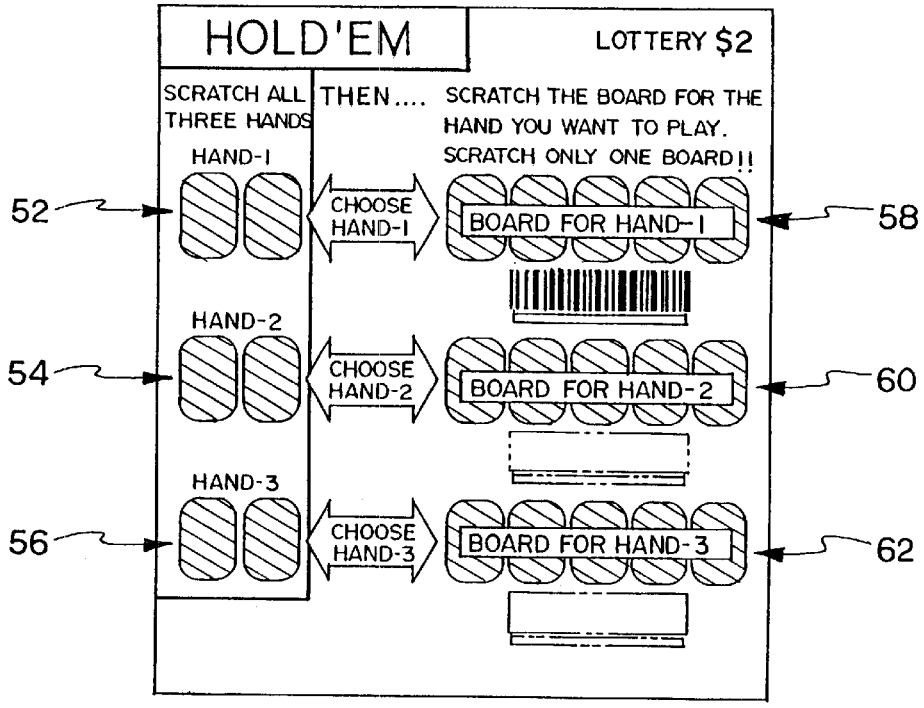
FIG. 3 shows a game simulating apparatus for the game "Hold'Em"
Figure 4:
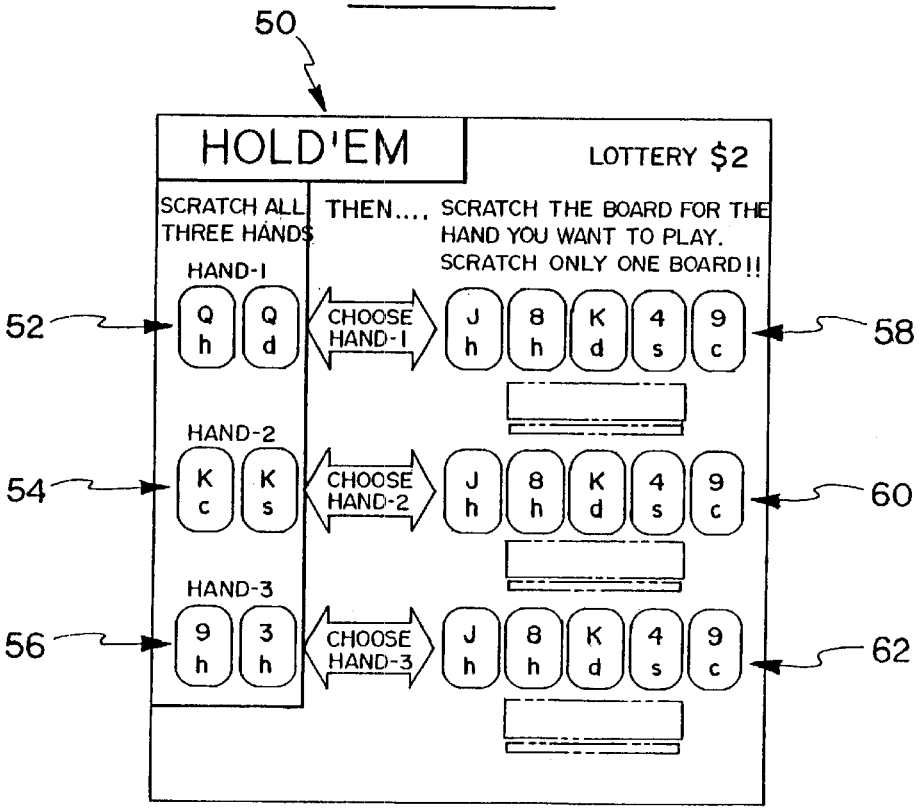
FIG. 4 is the game simulating apparatus of FIG. 3 having all hands revealed.

FIGS. 3 and 4 refer to another game called "Hold'Em". The game simulating apparatus 50 could be a scratch off game, a pull tab game, or could be played on a video display terminal. The game is played as follows: As shown in FIGS. 3 and 4, the player receives preferably three initial hands, each being displayed in a separate display area 52, 54 and 56, respectively. According to the display device used for playing the game, each of the player's hands displayed in areas 52, 54 and 56 may be revealed by either electronic means using the video display terminal, or if the game is played on a card for example, the values can be hidden beneath scratch off material or pull tabs. Upon revealing the values for each of the hands, one hand is selected and the corresponding board hidden at corresponding display areas 58, 60 and 62 is revealed.

Now looking at FIG. 4, each of the representational hands or display areas 52, 54 and 56 are revealed. After review of the value of those hands, it can be seen that display area 52 indicates a pair of queens. Display area 54 reveals a pair of kings and display area 56 reveals a nine and three of hearts. Based on evaluation of these three hands, the player then selects one board corresponding to one of the hands so that the highest possible poker hand values can be obtained when the card values displayed on one of the boards are added to the selected hand value. As can be seen in FIG. 4, the board values are all identical in that the resulting poker hand will be representational of five cards being added to the selected hand as they would have been had they been drawn from a deck. As can be seen if a player would have selected the hand displayed at area 54, then the player would have three kings which would be the highest possible choice. After selecting the highest choice on the apparatus 50, the player receives a corresponding prize.

Draw Poker

Figure 5:
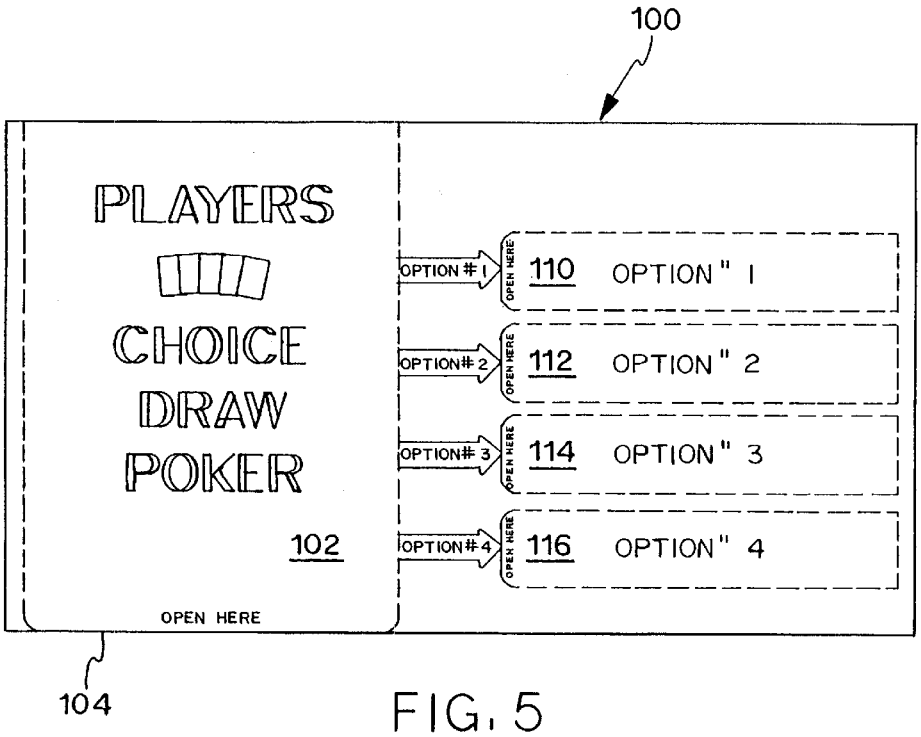
FIG. 5 is a game simulating apparatus for the game "Draw Poker"
Figure 6:
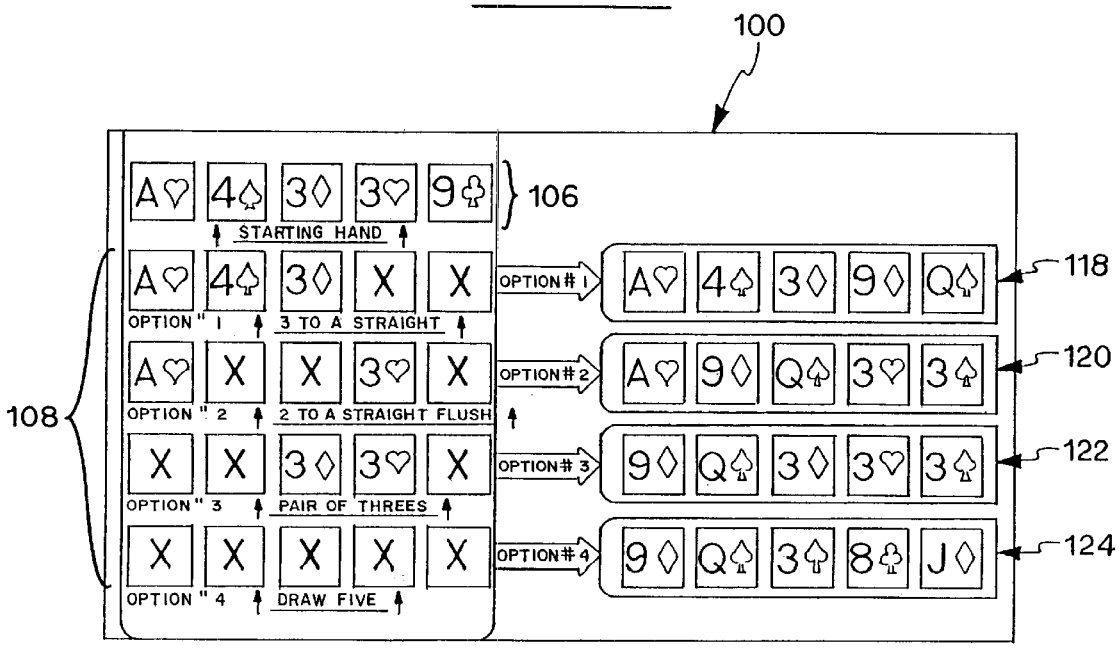
FIG. 6 shows the game simulating apparatus of FIG. 5 with all hands revealed.

FIGS. 5 and 6 show a game simulating apparatus 100 in the form of a pull tab card or ticket. It should be understood that this game also could be played with a scratch off material or with a video display terminal. In the pull tab game as shown, the game is initiated by lifting flap 102 from the bottom 104 to reveal the underlying starting hand 106 as well as the option field 108. Flap 102 could be replaced by opaque scratch off material, or in the case of a video display terminal, could merely be a display area that is revealed upon initiation of the game program. Referring back to FIG. 5, flaps 110, 112, 116 and 118 reveal a preferred number of option hands corresponding to the option field 108. In FIG. 6, all of the pull tabs 110, 112, 114 and 116 have been removed from the corresponding display areas 118, 120, 122 and 124. Each of the options have been revealed for simplification purposes, however when the game is actually played only one option will be revealed and revealing more than one option will void the ticket. With a video display terminal, possibilities of inadvertent player error are avoided, by electronically prohibiting improper play.

In order to play the game the player reviews the starting hand 106 and then makes a selection of one of the remaining options in the option field 108. After deciding which values to keep and which to discard, an option is selected which will provide replacement card values for those discarded. The new card values added will be received as though they were drawn from a deck, regardless of which card values were discarded. For example, in FIG. 6, with reference to the option display areas 118, 120, 122 and 124, the first replacement value would simulate being drawn a nine of diamonds from a card deck. The second replacement value drawn would simulate a queen of spades, the third replacement value drawn would be a three of spades, the fourth replacement value drawn would be an eight of clubs and the fifth replacement would be a jack of diamonds. However, if only three card values were discarded, then the player would only have added the nine of diamonds, the queen of spades, and the three of spades to the player's hand. Therefore, if the player selected option three and retained the pair of threes he would receive as new card values: the nine of diamonds, the queen of spades and the three of spades, so that the player would now have 3 threes in the hand. The object being to obtain the highest poker hand.

Pick Seven

Figure 7:
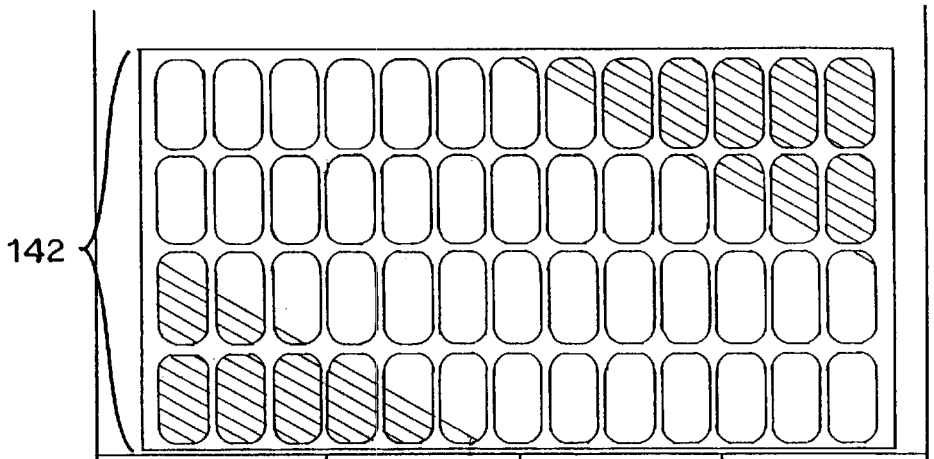
FIG. 7 shows a game simulating apparatus for playing the game "Pick Seven"
Figure 8:
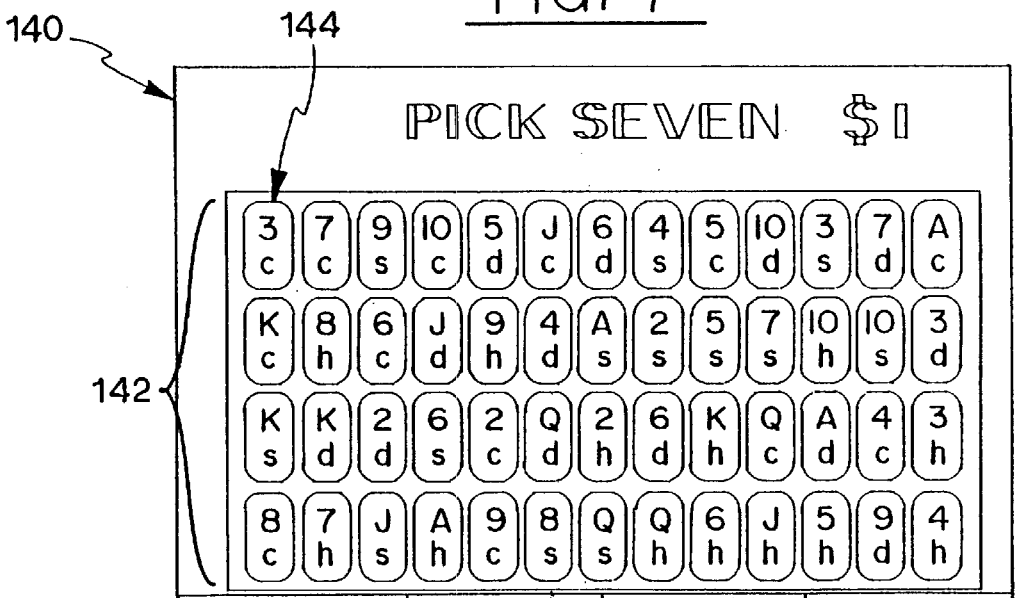
FIG. 8 shows the game simulating apparatus of FIG. 7 with all choices revealed.

FIGS. 7 and 8 show a game display apparatus 140 in which the player selects a poker hand from fifty-two card values randomly displayed on a defined display area 142 by uncovering individual representational values 144. This game could also be played on a scratch off ticket, as a pull tab game or on a video display terminal. The game is played by selecting five cards initially in an attempt to produce a winning poker hand. After selecting five card values, the player has the option to select one or two additional card values in an attempt to improve his hand over that obtained with selecting five card values. For example, if a player selects five card values and obtains two pairs, he then may elect to redeem his hand for five dollars or the player may elect to try to obtain a full house and if the next card selected produces a full house, the player will increase his take to $50.00. However, if the next card drawn does not produce a full house, he will have reduced his payoff to $2.00 (i.e., this payoff for the two pairs which he still holds). If the player then proceeds to select another card and obtains a full house then he will receive a take of $10.00, but if the selection of seven card values only produces two pairs he receives no prize.

As illustrated, the value of the prizes can be shown on the video terminal, on the video screen, or directly on the ticket in the case of game display apparatus 140 being in the form of a scratch-off ticket. It should be understood that other prizes or prize values may be awarded, the prize values shown are for exemplary purposes only.

The illustrated game display apparatus 140 has the advantage over prior art devices that no house intervention is required. That is, no owner of the video terminal (or seller of a scratch-off ticket) must actively reveal any hidden cards, as in prior art devices. Nor must the house determine whether the player has beaten a pre-revealed hand representing the house's hand. Rather, the player is playing against established rules that a "three of a kind" beats "two pair", for example. The established greater difficulty of obtaining "three of a kind" as opposed to "two pair" is reflected on the face of display 140 by the greater prize (e.g. $10.00 prize for three of a kind versus $5.00 prize for two pair when five (5) cards have been revealed.)

In the case of a video version of Pick Seven, it is contemplated that a player will be unable to inadvertently reveal more than seven (7) cards. In a scratch-off version, appropriate warnings may be provided to alert a user that the ticket is voided if more than seven (7) cards are revealed; i.e., the opaque covering material is scratched off.

It is contemplated that more than seven cards be revealed in some versions, with the count of revealed cards determining the prize awarded. Such a count can be established such as by a counting means described under Roulette below.

Roulette

Figure 9:
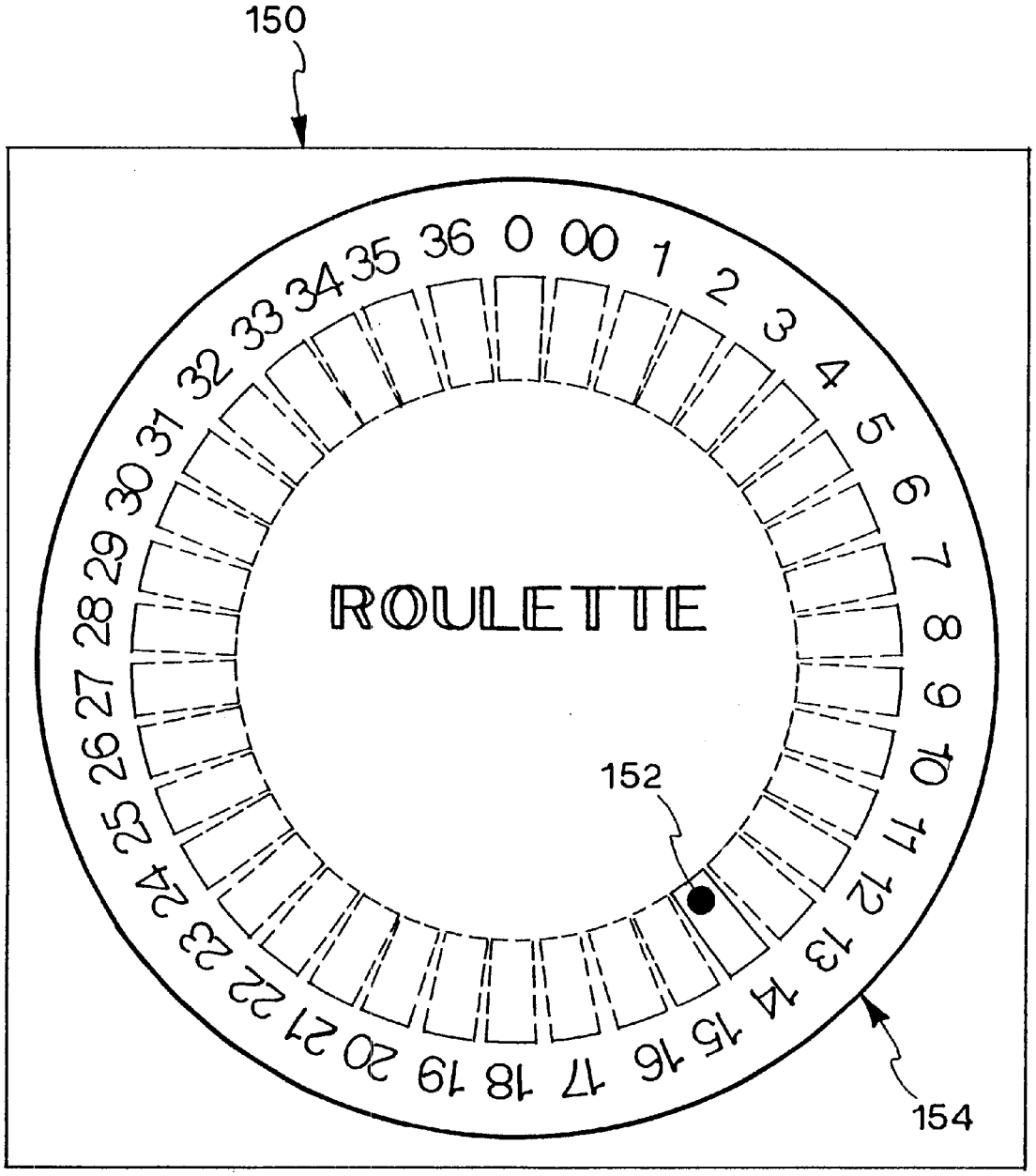
FIG. 9 shows a game simulating apparatus for playing roulette.

FIG. 9 shows a game display apparatus 150 for simulating the game of roulette. In this simulated game version a simulated ball representation 152 is located at one of the numbers on the simulated roulette wheel 154. The game is played by allowing the player to reveal one number in the hopes of locating the ball representation 152. In order to increase player interest, the player will be awarded other chances to reveal the hidden ball 152 with defined prize values. Preferably, the player will be given up to five chances to uncover the ball representation 152 with descending payoff amounts. If the player is unsuccessful then the player is given the option to attempt to uncover all other numbered areas without uncovering the ball representation 152 in order to win a prize. There will be means for counting the number of spaces or subregions required to be revealed in order to reveal the subregion in which ball representation 152 appears. It is contemplated that the amount of the prize awarded will be determined by the number of subregions revealed. In a video version, standard software will count the number of revealed subregions. In a scratch-off version, the number of revealed subregions will be readily counted by the seller or by machine.

Figure 10:
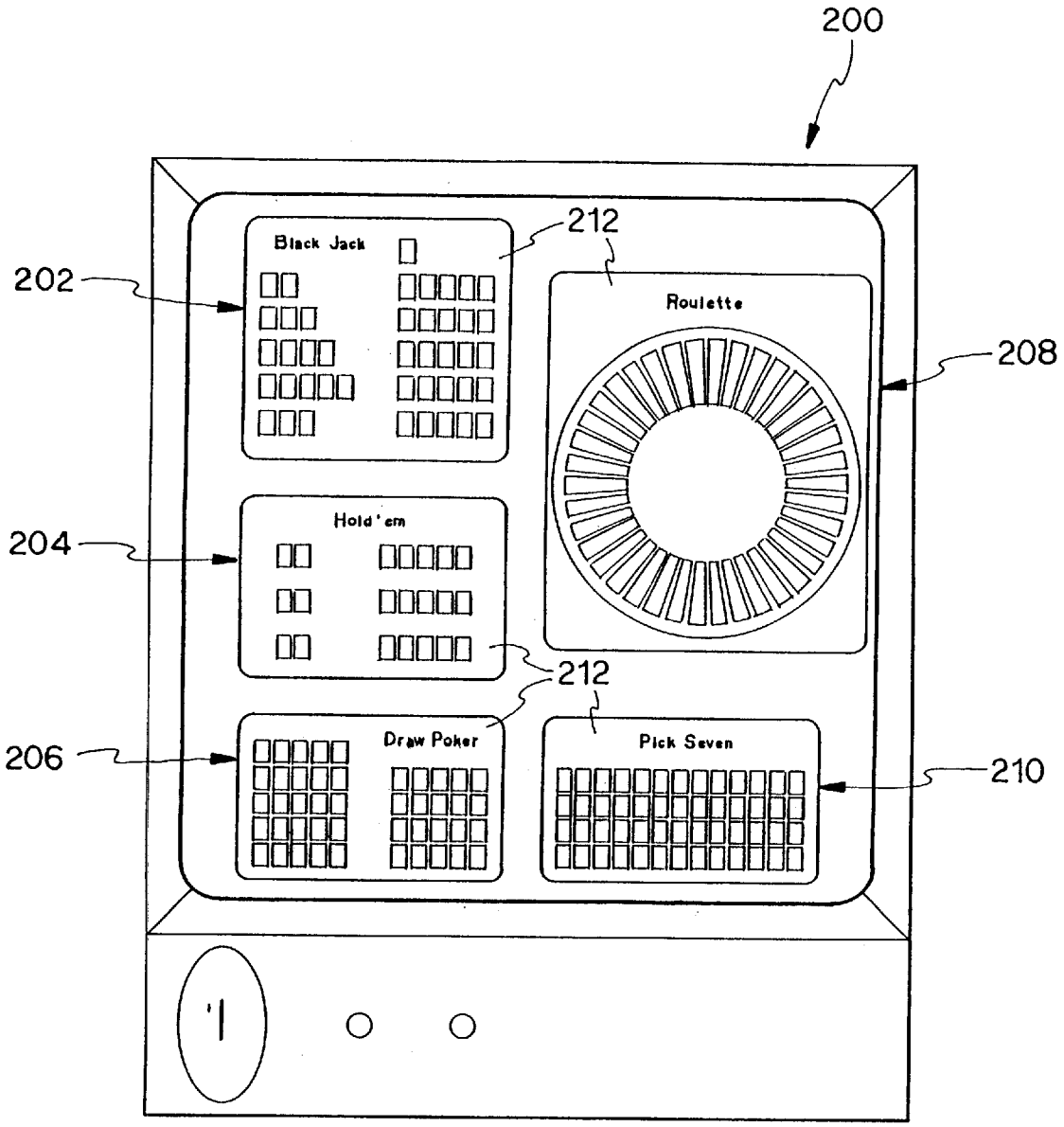
FIG. 10 shows the games of FIGS. 1–9 displayed on a video display terminal; and, FIG. 11 shows a further preferred embodiment of a game simulating apparatus for the game "Draw Poker", with suggested playing strategy.

FIG. 10 shows a video display terminal 200 with each game 202, 204, 206, 208, 210 displayed on its screen 212. Although one terminal may be dedicated to one game, FIG. 10 displays the option of having all five games displayed on one terminal 200 so that the player may select any game from that terminal 200.

Preferably one of games 202, 204, 206, 208 and 210 is selected from the screen 212 by touching that portion of the screen 212 which will initiate the stored computer program for that game.

Draw Poker With Suggested Strategy

Figure 11:
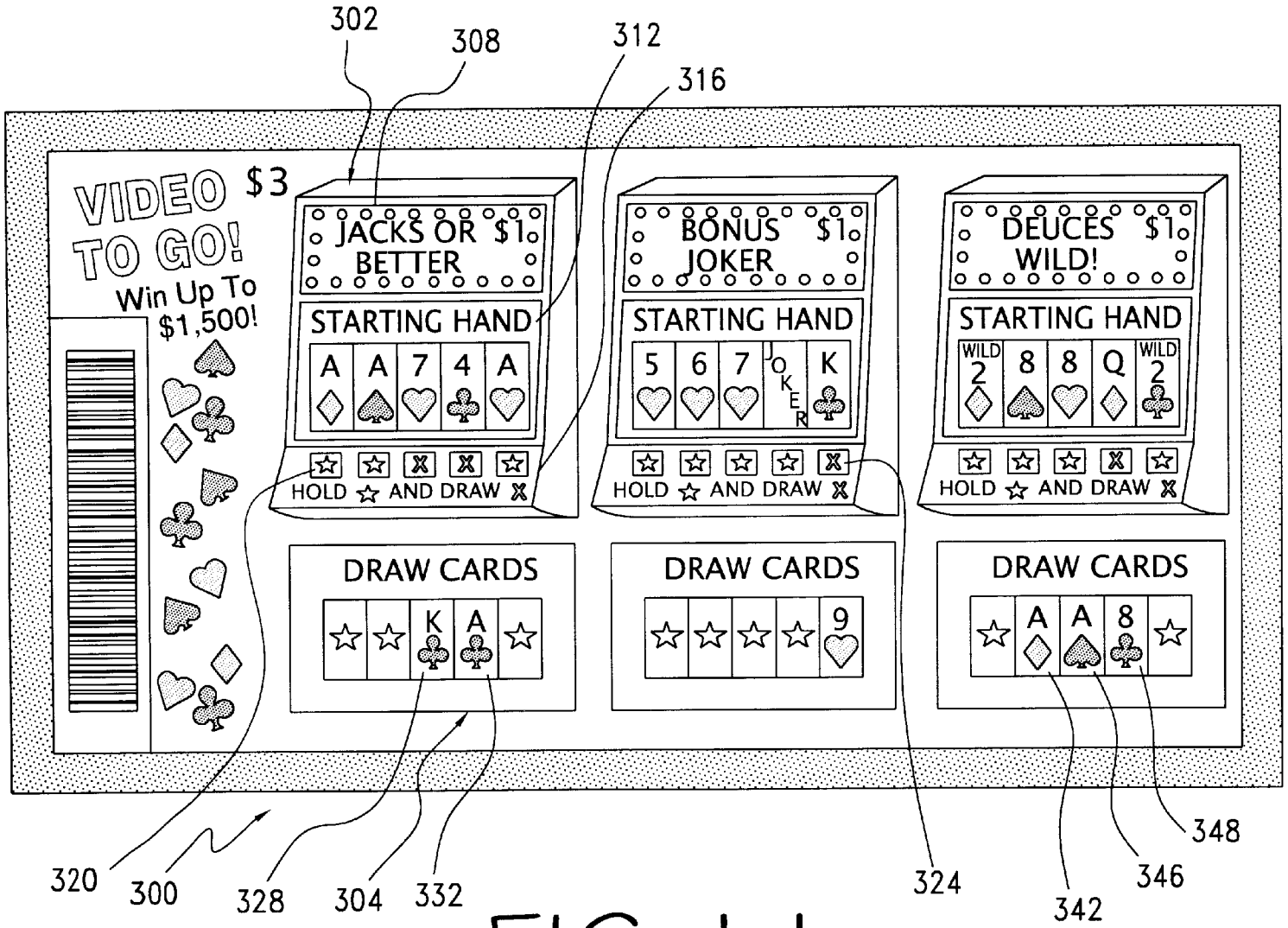

FIG. 11 shows a further preferred embodiment of a game simulating apparatus 300 in the form of a scratch-off lottery ticket. It will be appreciated that this game shown as five card draw poker, could also be played on a video display terminal, or in the form of a pull tab card or ticket and the like.

In the scratch-off card shown, a player's starting hand is displayed in a playing region 302. There is a counterpart region 304 in which one or more simulated draw cards are displayed. Both play region 302 and draw card region 304 are illustrated with scratch-off material removed. In the case of a video display terminal, those regions will initially be blank, or have a set or changing display pattern simulating a winning player's hand, for example. A title region 308 may be provided. In the illustrated embodiment, title region 308 reads "Jacks or Better" indicating the variation of draw poker which is being played, in the left one of the three illustrated draw poker games. The other exemplary draw poker games shown are "Bonus Joker" and "Deuces Wild". Particular rules governing those versions of draw poker will be sat forth below, along with sample prizes.

In the illustrated "Jacks or Better" embodiment, player's starting hand region 312 displays a user's initial five card hand including: ace of diamonds, ace of spades, seven of hearts, four of clubs, and ace of hearts.

An optional region 316 displays words or symbols corresponding to a "suggested" response by the player. Optional region 316 may be termed a suggested play region. Typically, the suggested response will correspond to generally accepted established gaming strategy. A sub-region 320 displays a star. In the illustrated example, the star located adjacent the three aces (i.e. one star located beneath each one of the ace of diamonds, ace of spades, and ace of hearts) corresponds to the suggestion that the player may wish to hold onto those illustrated aces. The suggested play region further includes the suggestion that the user "discard" the other two revealed cards (i.e., the revealed seven of hearts and four of clubs) under which the "X" symbols appear. That discard suggestion appears in a subregion 324.

In the illustrated example, the user has followed the suggestion of discarding the initially "dealt out" seven of hearts and four of clubs, and has been dealt a replacement king of clubs in sub-region 328 and an ace of clubs in sub-region 332, respectively. Play is now over, and the player has a final hand comprising four aces and a king, that is four of a kind (i.e., ace of diamonds, ace of spades, king of clubs, ace of clubs, and ace of hearts). It is contemplated that the user may ignore the house suggestion as to which cards from initial starting hand region 312 to discard, and discard cards, if any, based on the user's own strategy.

In the "Bonus Joker" version of draw poker illustrated, the user has followed the house advice to discard the king of clubs, the advice being in the form of the "X" shown in sub-region 324.

In the illustrated "Deuces Wild" version of draw poker, the player has followed the house suggestion as to which cards to discard and retain, only in part. The user discarded the eight of spades, eight of hearts, and queen of diamonds, and was given the ace of diamonds in sub-region 342, the ace of spades in sub-region 346, and the eight of clubs in sub-region 348, respectively. Thus, the user achieved a final hand comprising four of a kind, that is four aces and an eight of clubs (i.e., the wild two of diamonds, the ace of diamonds, the ace of spades, the eight of clubs and the wild two of clubs, each of the twos being useable as an ace.) If the user had followed the house suggestion of discarding only the queen of diamonds, and if the user had then been given a wild two (i.e., one of the remaining two of hearts and two of spades in a game version using a single 52-card deck) or an eight (i.e., the illustrated eight of clubs, or the remaining eight of diamonds), then the user would have had a final hand comprising five of a kind: that is, two wild twos and three eights or three wild twos and two eights.

In the case of a scratch-off ticket version of this preferred embodiment, it is contemplated that a user will be allowed to scratch-off as few as one sub-region, such as sub-region 348, at a time.

In the case of a video display terminal version of the game, it is contemplated that the user will be required to discard all cards to be discarded at once, in a manner similar to conventional draw poker. Thus, in the video version of this embodiment, it is expected that the user in the above example of "Deuces Wild" would designate which cards will be discarded, and when the decision is complete, the user will touch a portion of the video screen causing the discarded cards to be "taken away" and the newly given out cards to be dealt out.

Thus, in a scratch-off version where one card at a time can be "discarded" the user in the above example of "Deuces Wild" would likely have first scratched off and revealed sub-region 348 thereby revealing the eight of clubs. At that point, the player would recognize that three eights plus two wild cards yields a winning five of a kind hand, and would be unlikely to continue to scratch off regions 342 and 346.

SAMPLE DRAW POKER PAYOUTS

| PRIZES JACKS OR BETTER | PRIZES BONUS JOKER | PRIZES DEUCES WILD |
|---|---|---|
| * GAME USES STANDARD DECK OF 52 PLAYING CARDS | * GAME USES STANDARD DECK OF 52 PLAYING CARDS PLUS A WILD JOKER | * GAME USES STANDARD DECK OF 52 PLAYING CARDS WITH 4 "WILD DEUCES" |
| * ACE IS HIGH OR LOW FOR STRAIGHTS | * ACE IS HIGH OR LOW FOR STRAIGHTS | * ACE IS HIGH OR LOW FOR STRAIGHTS |
| PAIR OF JACKS, QUEENS, KINGS OR ACES . . . $1 | TWO PAIR . . . $1 | THREE OF A KIND . . . $1 |
| TWO PAIR . . . $2 | THREE OF AKIND . . . $2 | STRAIGHT . . . $2 |
| THREE OF A KIND . . . $3 | STRAIGHT . . . $3 | FLUSH . . . $3 |
| STRAIGHT . . . $4 | FLUSH . . . $4 | FULL HOUSE . . . $4 |
| FLUSH . . . $5 | FULL HOUSE . . . $5 | FOUR OF A KIND . . . $10 |
| FULL HOUSE . . . $10 | FOUR OF A KIND . . . $10 | STRAIGHT FLUSH . . . $25 |
| FOUR OF A KIND . . . $25 | STRAIGHT FLUSH . . . $50 | FIVE OF A KIND . . . $50 |
| STRAIGHT FLUSH. . . $250 | ROYAL FLUSH . . . $250 (with Joker) | ROYAL FLUSH . . . $250 (with Deuce) |
| ROYAL FLUSH . . . $500 | ROYAL FLUSH . . . $500 (w/o Joker) | ROYAL FLUSH . . . $500 (w/o Deuce) |

The above-illustrated Sample Draw Poker Payouts may be used with the variations in the embodiment of FIG. 11. Each of the three rules may appear on a scratch-off or pull tab card. In the video version of the game, the rules can be displayed on the video screen, alternating with display of the game, for example.

In each of the foregoing examples, it should be understood that the games may be played interchangeably as video format games or scratch-off tickets or pull tab games. While VDT, pull tabs and scratch-off formats have been used for casino type gambling games, the game simulations described above provide interchangeability between the three formats which is a highly desirable and important aspect of this invention.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A game simulating apparatus, comprising:

a) a game display device;

b) a plurality of regions provided on said game display device, at least one of said regions being configured for displaying at least one game representational value;

c) a first one of said regions being a player's starting hand region;

d) said player's starting hand region including a plurality of initially unrevealed subregions having a playing card representation therein; the subregions being revealed when play begins, the revealed subregions having permanent and observable playing card representations after play begins and the subregions are revealed;

e) a second one of said regions being a draw card region;

f) said draw card region including a plurality of initially unrevealed draw card subregions having a playing card representation therein, the draw card subregions being revealable when a player makes a selection, the selection resulting in a permanent and observable playing card representation after a player makes a selection; and, g) each one of said playing card representations in said draw card subregions being directly correlated with one of said starting hand subregion playing card representations for simulating replacing the one said starting hand playing card representation with the directly correlated one draw card representation to simulate play in a card game being simulated.

2. A game simulating apparatus as defined in claim 1, wherein:

a) a third one of said regions includes a suggested play region; and, b) said suggested play region includes a symbol configured for representing to a player that one of said playing card representations from said starting hand region be replaced with one of said draw card subregion playing card representations.

3. The game simulating apparatus as set forth in claim 2, wherein:

a) said game display device includes a video screen.

4. The game simulating apparatus as set forth in claim 2, wherein:

a) said game display device includes a scratch-off card.

5. A game simulating apparatus as defined in claim 1, wherein:

a) a third one of said regions includes a suggested play region; and, b) said suggested play region includes a symbol configured for representing to a player that one of said playing card representations from said starting hand region be retained.

6. The game simulating apparatus as set forth in claim 5, wherein:

a) said game display device includes a video screen.

7. The game simulating apparatus as set forth in claim 5, wherein:

a) said game display device includes a scratch-off card.

8. A game simulating apparatus as defined in claim 1, wherein:

a) said plurality of player's starting hand subregions is configured for displaying a simulated draw poker game.

9. The game simulating apparatus as set forth in claim 8, wherein:

a) said game display device includes a video screen.

10. A game simulating apparatus as defined in claim 1, wherein:

a) a final player's hand is established by taking together unreplaced playing card representations from said player's starting hand region and revealed playing card representations from said draw card region.

11. The game simulating apparatus as set forth in claim 10, wherein:

a) said game display device includes a video screen.

12. The game simulating apparatus as set forth in claim 1, wherein:

a) said game display device includes a scratch-off card.

13. A game simulating apparatus, comprising:

a) a game display device;

b) a game playing region provided on said game display device, said region being configured for displaying a plurality of subregions;

c) each one of said subregions having a game representational value therein, the subregions being initially unrevealed and revealable when the player makes a selection, the selection resulting in a permanent and observable game representational value;

d) a preselected winning game representational value being initially unrevealed and disposed in one of said subregions of said game playing region;

e) said game playing region being configured for only a single one of said subregions to be revealed at a time;

f) means for counting the number of revealed game representational values;

g) a winner of play of the game simulating apparatus being determined by the number of revealed game representational values counted by said counting means and by the preselected winning game representation value being revealed.

14. The game simulating apparatus as set forth in claim 13, wherein:

a) said game representational value corresponds to a roulette ball.

15. The game simulating apparatus as set forth in claim 13, wherein:

a) said game representational value corresponds to a playing card.

16. The game simulating apparatus as set forth in claim 15, wherein:

a) said game playing region is configured for representing a game of Pick Seven.

17. The game simulating apparatus as set forth in claim 16, wherein:

a) said game display device includes a vidio screen.

18. The game simulating apparatus as set forth in claim 15, wherein:

a) said game display device includes a scratch-off card.

19. The game simulating apparatus as set forth in claim 15, wherein:

a) said game display device includes a video screen.

20. The game simulating apparatus as set forth in claim 6, wherein:

a) said game playing region is configured for representing a game of Pick Seven.

21. The game simulating apparatus as set forth in claim 13, wherein:

a) said game display device includes a scratch-off card.

22. The game simulating apparatus as set forth in claim 13, wherein:

a) said game display device includes a video screen.

* * * * *